US007355336B2

(12) United States Patent
Sagawa et al.

(10) Patent No.: US 7,355,336 B2
(45) Date of Patent: Apr. 8, 2008

(54) IMAGE DISPLAY DEVICE

(75) Inventors: Masakazu Sagawa, Inagi (JP); Toshimitsu Watanabe, Yokohama (JP); Yoshiro Mikami, Hitachiota (JP); Toshiaki Kusunoki, Tokorozawa (JP); Mutsumi Suzuki, Kodaira (JP)

(73) Assignee: Hitachi Displays, Ltd., Hayano Mobara-Shi (JP)

( * ) Notice: Subject to any disclaimer, the term of this patent is extended or adjusted under 35 U.S.C. 154(b) by 255 days.

(21) Appl. No.: 11/325,549

(22) Filed: Jan. 5, 2006

(65) Prior Publication Data

US 2006/0202605 A1 Sep. 14, 2006

(30) Foreign Application Priority Data

Mar. 11, 2005 (JP) ..... 2005-069630

(51) Int. Cl.
*H01J 1/62* (2006.01)

(52) U.S. Cl. ..... 313/495; 313/309

(58) Field of Classification Search ..... 313/495–497, 313/309, 336, 351

See application file for complete search history.

(56) References Cited

FOREIGN PATENT DOCUMENTS

| | | |
|---|---|---|
| JP | 7-65710 | 3/1995 |
| JP | 10-153979 | 6/1998 |

OTHER PUBLICATIONS

Kuniyoshi Yokoo et al., "Emission Characteristics of Metal-Oxide-Semiconductor Electron Tunneling Cathode", J. Vac. Science Technology B 11(2), Mar./Apr. 1993, pp. 429-432.

Nobuyasu Negishi et al., "High Efficiency Electron-Emission in Pt/SiO/Si/ SI Structure", Japan J. Applied Phys. vol. 36 (1997) pp. L939-L941, Part 2, No. 7B, Jul. 15, 1997.

*Primary Examiner*—Vip Patel
(74) *Attorney, Agent, or Firm*—Antonelli, Terry, Stout & Kraus, LLP.

(57) ABSTRACT

The present invention provides an image display device free of display defects and with high reliability to prevent destruction of electron sources due to injection of electric charge.

On the outermost periphery of a display region, there are provided a bottom electrode 11 serving as data line, a scan line bus 21 serving as scan line, and dummy potential fixing electrodes 11D1, 11D2, 21D1 and 21D2 not contributing to image display, and these are connected with electrodes 70 and 80 with low impedance and constant potential.

5 Claims, 12 Drawing Sheets

IMAGE DISPLAY DEVICE

CLAIM OF PRIORITY

The present application claims priority from Japanese application JP 2005-069630 filed on Mar. 11, 2005, the content of which is hereby incorporated by reference into this application.

BACKGROUND OF THE INVENTION

The present invention relates to an image display device. In particular, the invention relates to an image display device, which is also called a flat panel display of emissive type using thin-film type electron source array.

A type of image display device (field emission display; FED) has been developed, which uses emission type electron sources in micro-size and of integratable type, also called thin-film type electron sources. In this type of image display device, electron source is divided to emission type electron source and hot electron type electron source, etc. Those belonging to the former group include: Spindt type electron source, surface conduction type electron source, carbon nano-tube type electron source. Those belong to the latter group include: MIM (metal-insulator-metal) type with a metal layer, an insulator layer, and a metal layer laminated on each other, MIS (metal-insulator-semiconductor) type with a metal layer, an insulator layer, and a semiconductor layer laminated on each other, and thin-film type electron source such as metal-insulator-semiconductor-metal type.

The MIM type is described in the Patented Reference 1, for instance. As the metal-insulator-semiconductor type, MOS type is described in the Non-Patented Reference 1. As the metal-insulator-semiconductor-metal type, HEED type is disclosed in the Non-Patented Reference 2 and others. EL type is described in the Non-Patented Reference 3, and porous silicon type is disclosed in the Non-Patented Reference 4 and others.

The MIM type electron source is disclosed, for instance, in the Patented Reference 2. The structure and the operation of the MIM type electron source are as follows: An insulation layer is interposed between a top electrode and a bottom electrode. By applying voltage between the top electrode and the bottom electrode, electrons near Fermi level in the bottom electrode pass through potential barrier by the tunneling phenomena and are injected to a conduction band of the insulation layer, which serves as an electron accelerator. The electrons are turned to hot electrons and flow into the conduction band of the top electrode. Among these electrons, those reaching the surface of the top electrode and having energy of higher than the work function $\phi$ of the top electrode are emitted into vacuum space.

[Patented Reference 1] JP-A-7-65710

[Patented Reference 2] JP-A-10-153979

[Non-Patented Reference 1] J. Vac. Sci. Technol.; B11 (2); pp. 429-432, (1993).

[Non-Patented Reference 2] High-Efficiency-Electro-Emission Device, Jpn. J. Appl. Phys.; Vol. 36; pp. 939.

[Non-Patented Reference 3] Electroluminescence; Appl. Phys.; Vol. 63, No. 6, p. 592.

[Non-Patented Reference 4] Appl. Phys.; Vol. 66, No. 5, p. 437.

In the image display device using this type of thin-film type electron sources, electron sources are often destroyed due to unexpected electric charge or discharge during the manufacturing process or the display operation. In particular, the electron sources positioned on the outermost periphery of the display region are often destroyed. When electron sources are destroyed, display defect occurs, and all electron sources connected to data line may fall into display failure.

It is an object of the present invention to provide an image display device, free of display defects and having high reliability, by which it is possible to prevent the destruction of the electron sources as described above.

To attain the above object, the present invention provides a dummy potential fixing electrode, which does not contribute to image display and is similar to data line or scan line, on the outermost periphery of the display region. This potential fixing electrode is connected to an electrode with low impedance and constant potential.

The electric charge injected during the manufacturing process is absorbed by the dummy potential fixing electrode on the outermost periphery of the display region, and the electron sources for display operation are protected from destruction.

DETAILED DESCRIPTION OF THE PREFERRED EMBODIMENT

Figure 1:
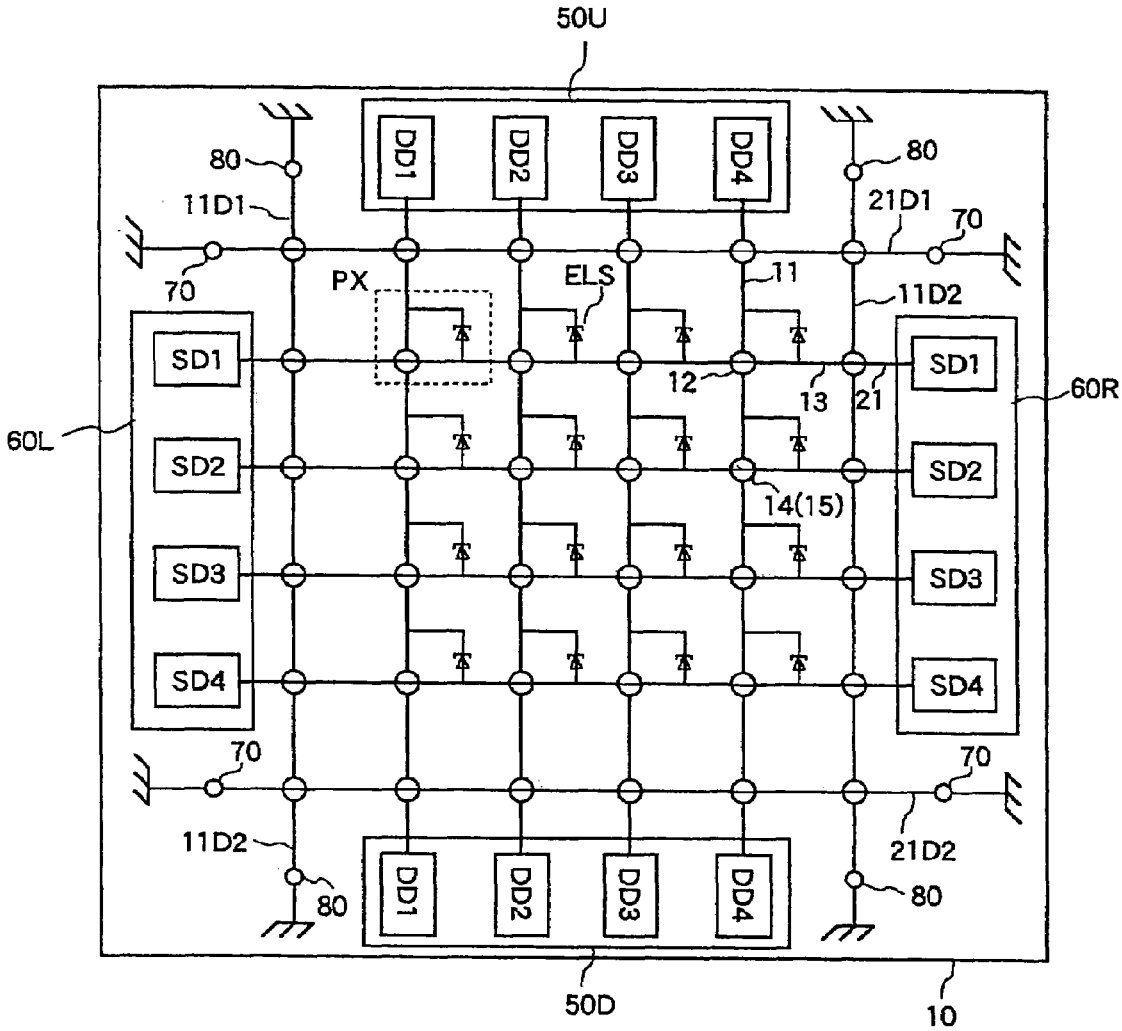
FIG. 1 is a schematical plan view of a cathode substrate to explain Embodiment 1 of an image display device according to the present invention.

Detailed description will be given below on an embodiment of the present invention referring to the drawings. In the following, description will be given on a MIM (metal-insulator-metal) type electron source (cathode) as an example, while the invention can be applied in the same manner to the other type of thin-film type cathode.

Embodiment 1

FIG. 1 is a schematical plan view of a cathode substrate to explain Embodiment 1 of an image display device according to the present invention. A bottom electrode 11, serving as data line, and a top electrode 13, to which electric current is supplied via a scan line (scan line bus) 21 in FIG. 1, are arranged (normally crossing perpendicularly to each other) on inner surface of a cathode substrate 10 preferably made of glass and positioned at an intersection via a field insulator 14 and an interlayer insulator 15. At the intersections, pixels PX comprising electron sources ELS are arranged in form of matrix.

The bottom electrode 11, serving as data line, is directly provided above and below the cathode substrate 10 or it is driven by data line driving circuits 50U and 50D connected with a flexible printed board. The data line driving circuits 50U and 50D comprise data line driving circuit chips DD1, DD2, DD3, DD4, . . . corresponding respectively to the bottom electrode 11. The scan line bus 21 is driven by scan line driving circuits 60L and 60R directly arranged on left and right of the cathode substrate 10 or connected with the flexible printed board. The scan line driving circuits 60L and 60R comprise scan line driving circuit chips SD1, SD2, SD3, SD4, . . . corresponding respectively to the scan line buss 21. The data line bus line and the scan line bus of the image display device are designed as both-side driving type, while bus lines of unilateral driving on one side or both sides are also known.

The electron source ELS is designed in laminated structure and comprises the bottom electrode 11, a tunneling insulator 12, serving as an electron accelerator, which is formed through anodic oxidation of the surface of the bottom electrode 11, and the top electrode 13. Electric current to the top electrode 13 is supplied via the scan line bus 21. A region where the electron sources ELS are arranged in form of matrix is referred as a display region AR.

In FIG. 1, potential fixing electrodes 11D1 and 11D2 are provided on outside of left and right of the bottom electrode 11, which serves as data line, and these are connected respectively to an electrode member 80 kept at a constant voltage with low impedance. Also, potential fixing electrodes 21D1 and 21D2 are provided on outside at left and right of the scan line bus 21 to supply electric current to the top electrode 13. For the electron source ELS of the pixel PX to contribute to the display, the tunneling insulator is interposed between the bottom electrode 11 and the top electrode 13. At each of the intersections of the potential fixing electrodes 11D1 and 11D2 and the potential fixing electrodes 21D1 and 21D2, the field insulator 14 or the interlayer insulator 15 may be arranged, while it is desirable that these have the same arrangement as the pixels to facilitate the manufacture.

Figure 2:
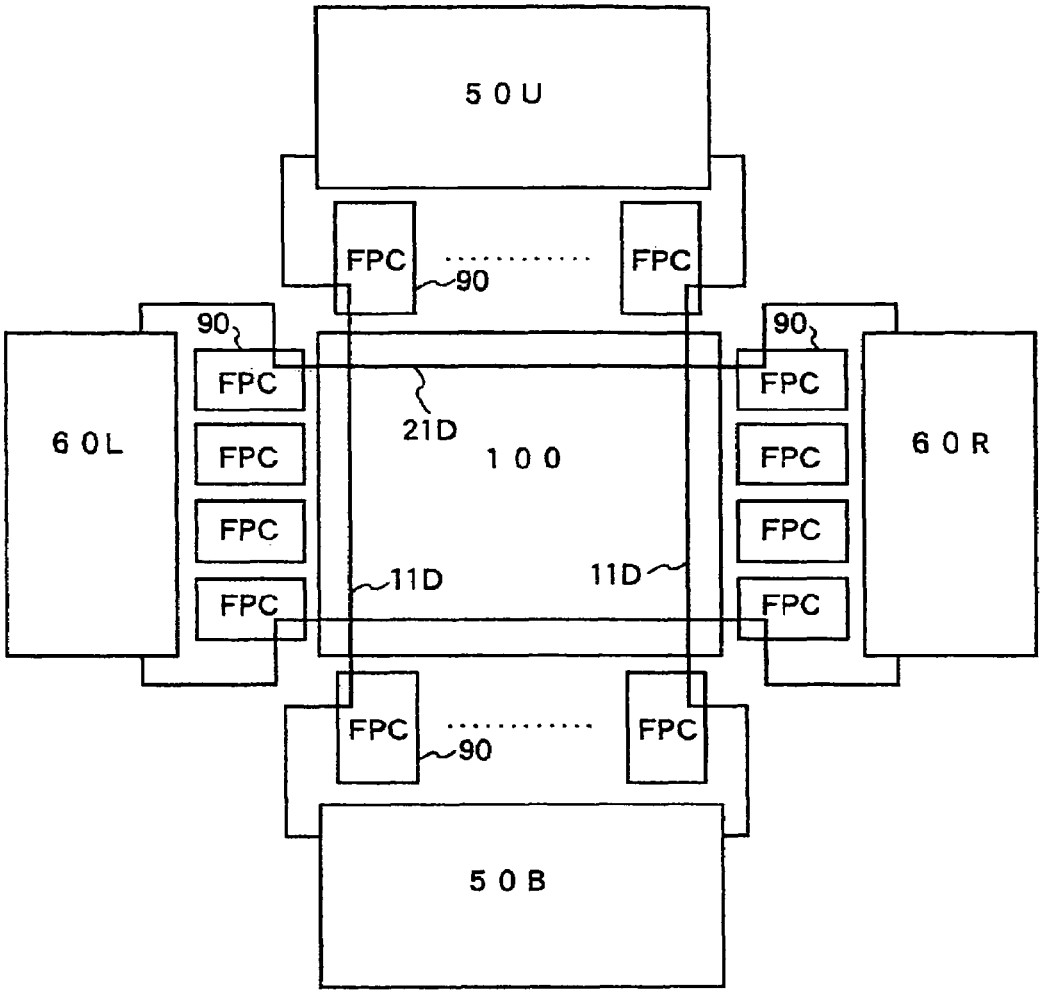
FIG. 2 is a block diagram to explain an example of a more concrete arrangement of the image display device of the present invention.

FIG. 2 is a block diagram to explain a more concrete arrangement of the image display device of the present invention. Around a display panel 100, which makes up a screen of the image display device, there are provided the data line driving circuits 50U and 50D and the scan line driving circuits 60L and 60D via the flexible printed board 90.

In this arrangement, the potential fixing electrodes 11D1 and 11D2 and the potential fixing electrodes 21D1 and 21D2 provided on outer periphery of the display region are led to the data line driving circuits 50U and 50D and the scan line driving circuits 60L and 60R via the flexible printed board 90 and are connected to a constant power source of each driving circuit.

In the embodiment as described above, the potential fixing electrodes are provided on all of four sides on outer periphery of the display region, while these can be provided on each of the adjacent two sides, and also on two sides running in parallel or only on one side to attain the same effect.

Figure 3:
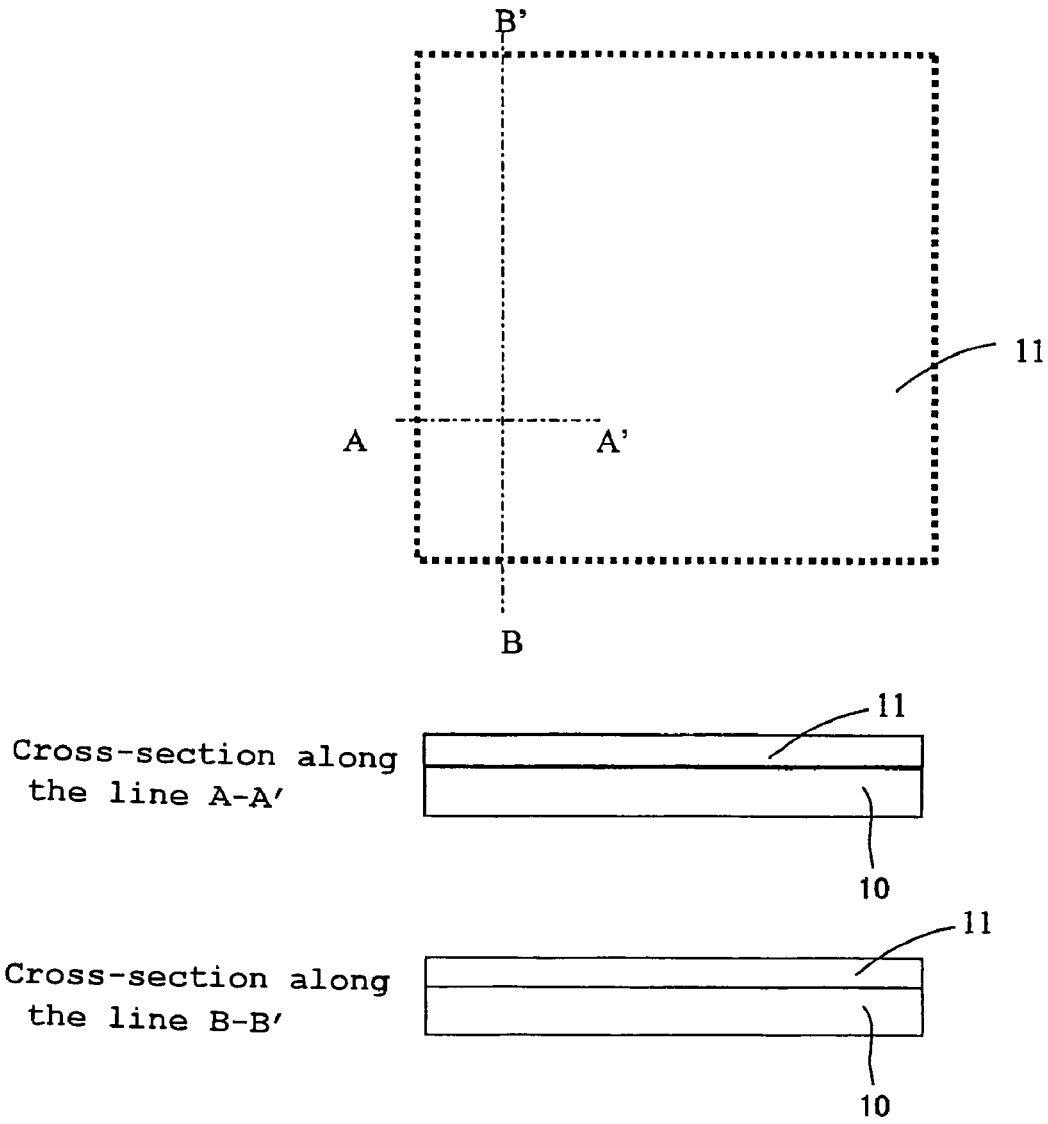
FIG. 3 represents drawings to explain a method for manufacturing a thin-film type electron source of the present invention.

Next, description will be given on detailed arrangement of the cathode substrate of the image display device of the present invention and on the manufacturing process as shown in FIG. 3 to FIG. 11. First, as shown in FIG. 3, a metal film for the bottom electrode 11 is formed on the glass substrate 10. As the material of the bottom electrode 11, aluminum type metal is used. Aluminum type metal is used because an insulating film of high quality can be formed by anodic oxidation. Here, Al—Nd alloy is used, which is obtained by doping aluminum with Nd at 2 atom %. For film deposition, sputtering method is used, for instance. Film thickness is set to 300 nm.

Figure 4:
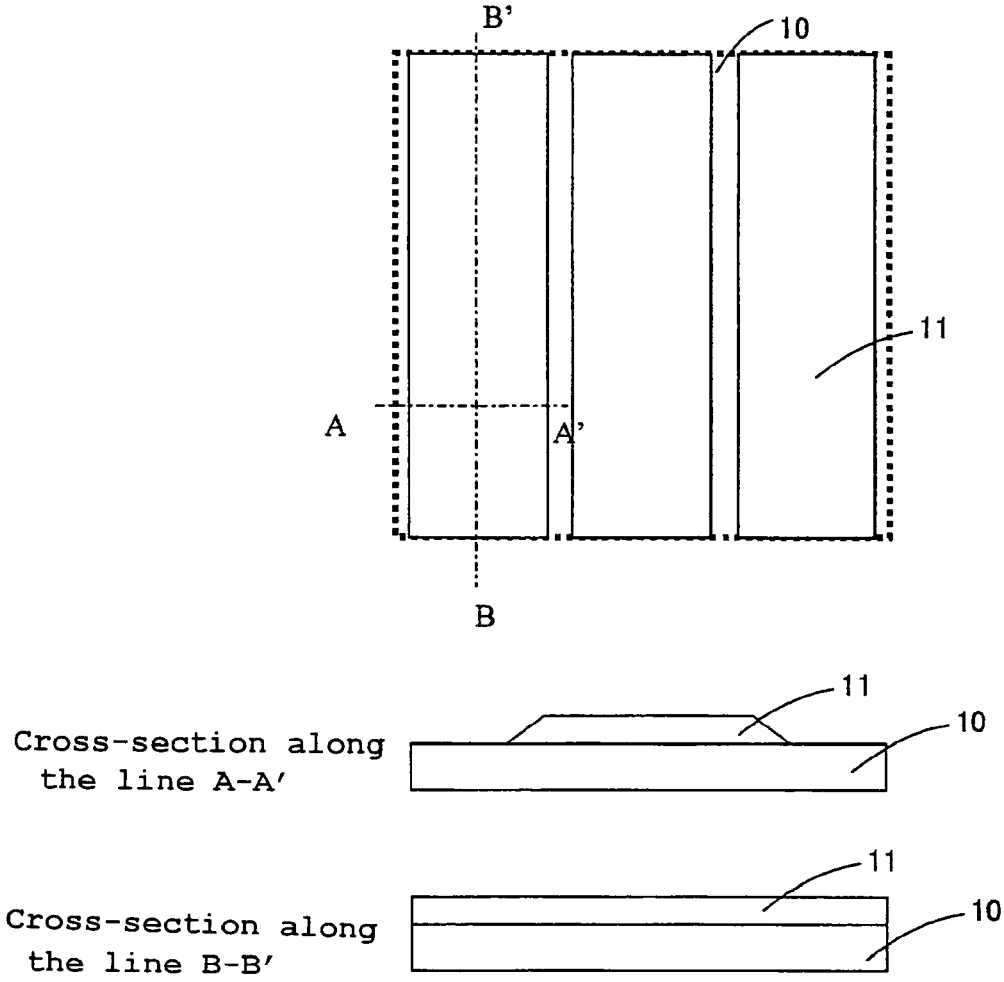
FIG. 4 represents drawings similar to those of FIG. 3, showing a method for manufacturing the thin-film type electron source of the present invention.

After film deposition, the bottom electrode 11 in form of stripe is produced by patterning process and etching process (FIG. 4). The width of the bottom electrode 11 differs according to size or resolution of the image display device. It is set to a value approximately equal to pitch of sub-pixel, i.e. about 100-200 μm. For the etching, wet etching using a mixed solution of phosphoric acid, acetic acid and nitric acid is adopted. Because the electrode is designed in simple stripe-like structure with broad width, inexpensive proximity light exposure or printing method can be used for resist patterning.

Figure 5:
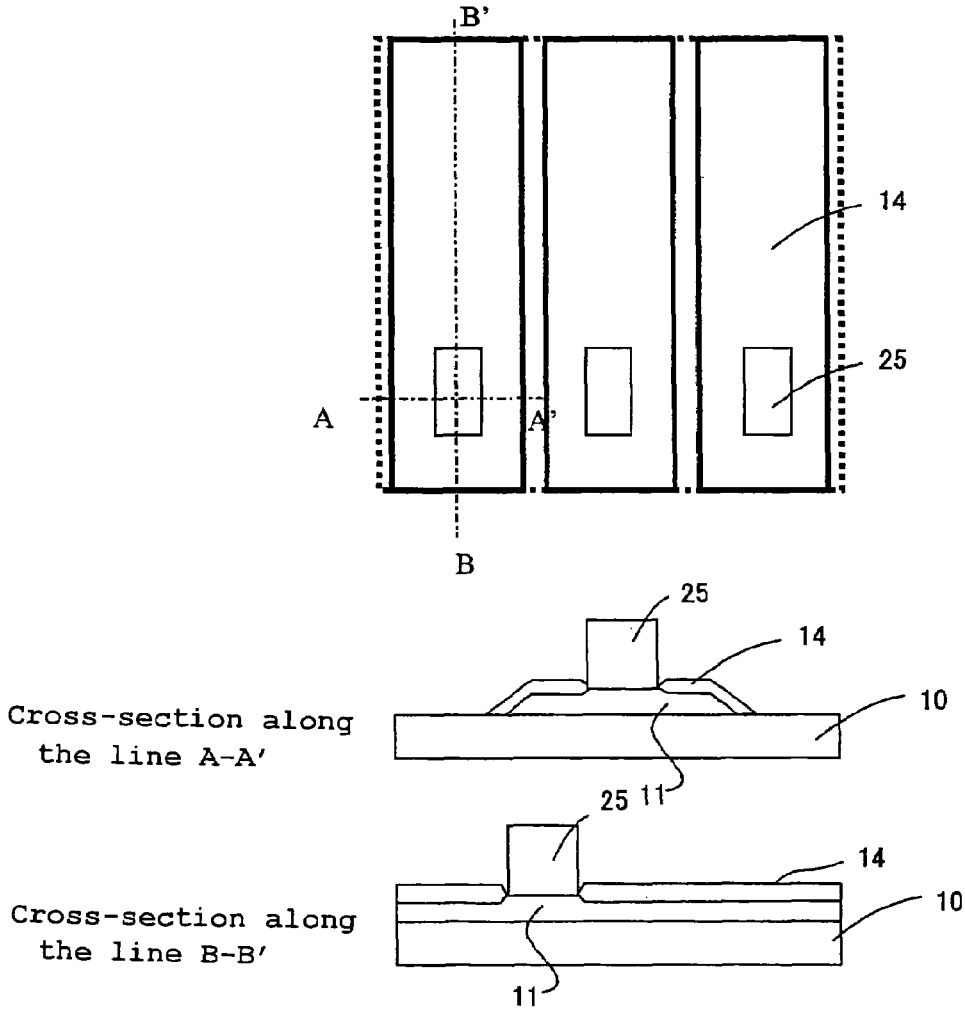
FIG. 5 represents drawings similar to those of FIG. 4, showing a method for manufacturing the thin-film type electron source of the present invention.
Figure 6:
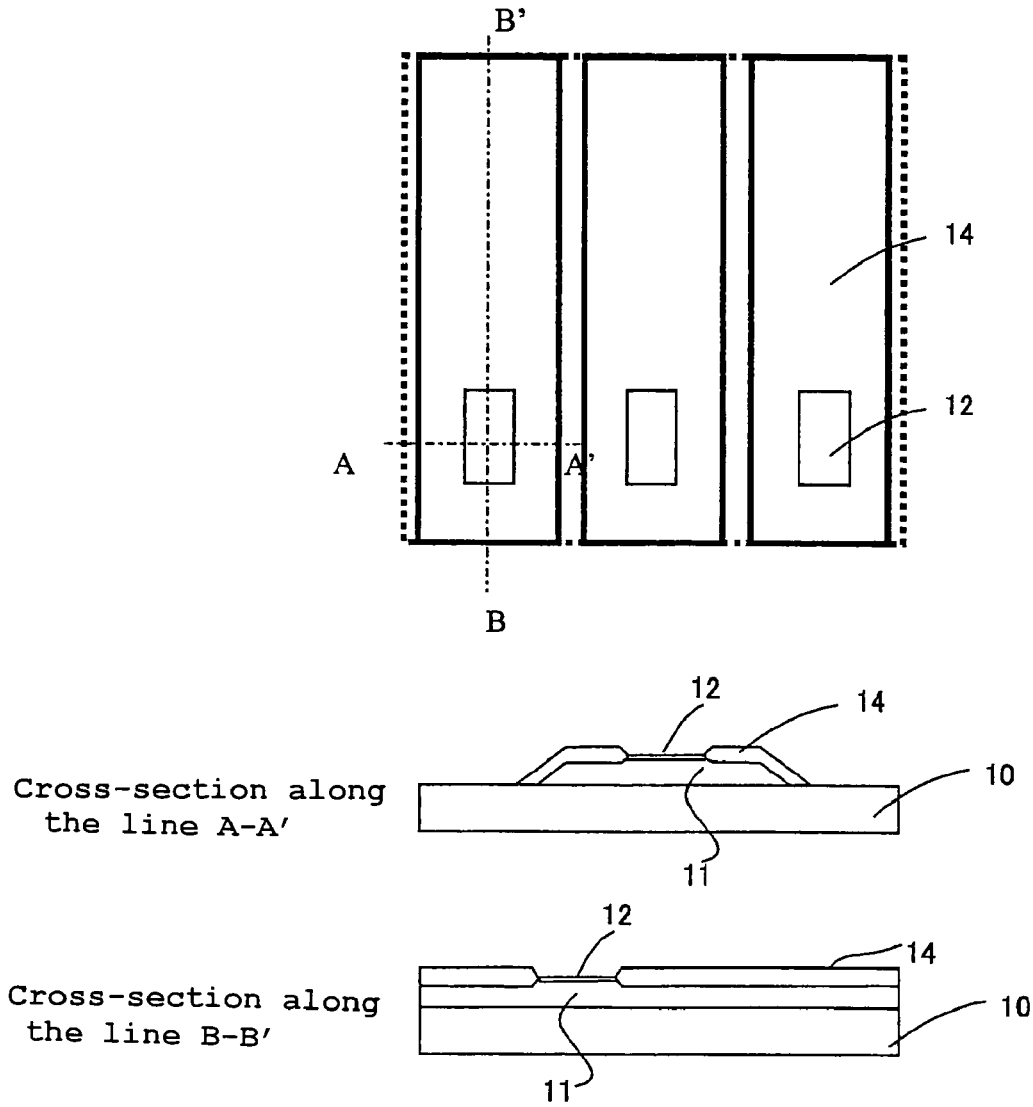
FIG. 6 represents drawings similar to those of FIG. 5, showing a method for manufacturing the thin-film type electron source of the present invention.

Next, the field insulator (also called protection insulator) 14 and the tunneling insulator 12 are formed to limit the electron emission region and to prevent electrostatic focusing to the edge of the bottom electrode 11. First, a portion on the bottom electrode 11 as shown in FIG. 5, which is to be turned to the electron emission region, is masked by a photoresist 25. The other portion is selectively and thickly processed by anodic oxidation to provide the field insulator 14. When the processing voltage is set to 100 V, the protection insulator 14 of 136 nm in thickness can be formed. Then, the photoresist 25 is removed, and the remaining surface of the bottom electrode 11 is processed by anodic oxidation. For example, if the processing voltage is set to 6 V, the insulation layer (tunneling insulator) 12 of about 10 nm in thickness is formed on the bottom electrode 11 (FIG. 6).

Figure 7:
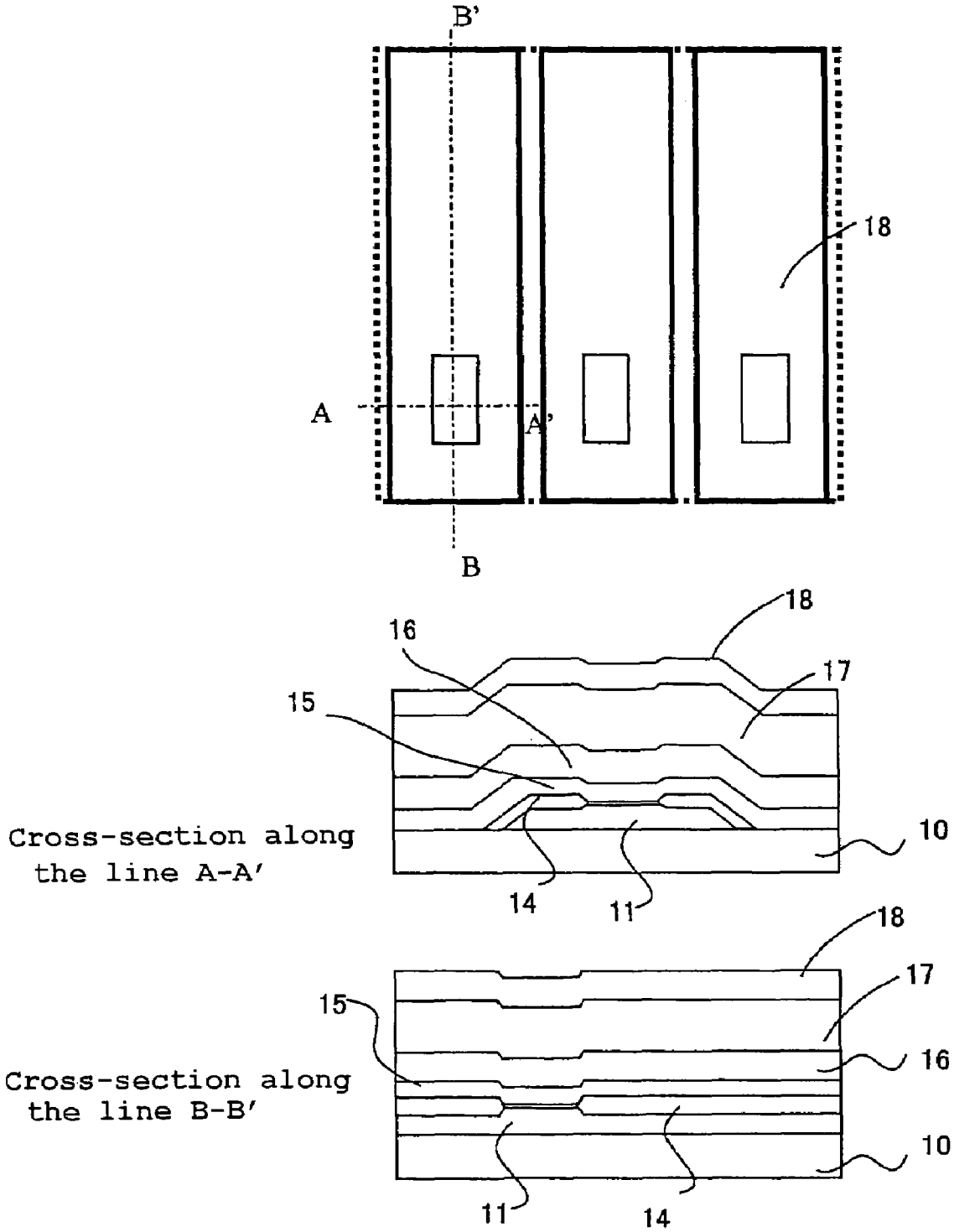
FIG. 7 represents drawings similar to those of FIG. 6, showing a method for manufacturing the thin-film type electron source of the present invention.

Next, in order to arrange the scan line bus to supply electric current to the interlayer insulator 15 and to the top electrode 13 and to spacers (to be described later), a metal film is formed by sputtering method, for instance, which serves as a spacer electrode to electrically connect the spacer to the scan line bus (FIG. 7). Then, if there is a pinhole on the field insulator 14 formed by anodic oxidation, the interlayer insulator 15 plays a role to fill up the defect and to maintain insulation between the bottom electrode 11 and the scan line bus. As a metal intermediate layer 17 of the scan line bus, thick aluminum wire is used, and it is formed as a 3-layer film interposed between a metal lower layer 16 and a metal upper layer 18. Here, chromium is used as the metal lower layer 16 and the metal upper layer 18. To reduce wiring resistance, aluminum film should be made as thick as possible. The metal lower layer 16 is designed to have a thickness of 100 nm, the metal intermediate layer 17 to have a thickness of 4 μm, and the metal upper layer 18 to have a thickness of 100 nm. The metal intermediate layer 17 may be formed by screen printing method using conductive paste.

Figure 8:
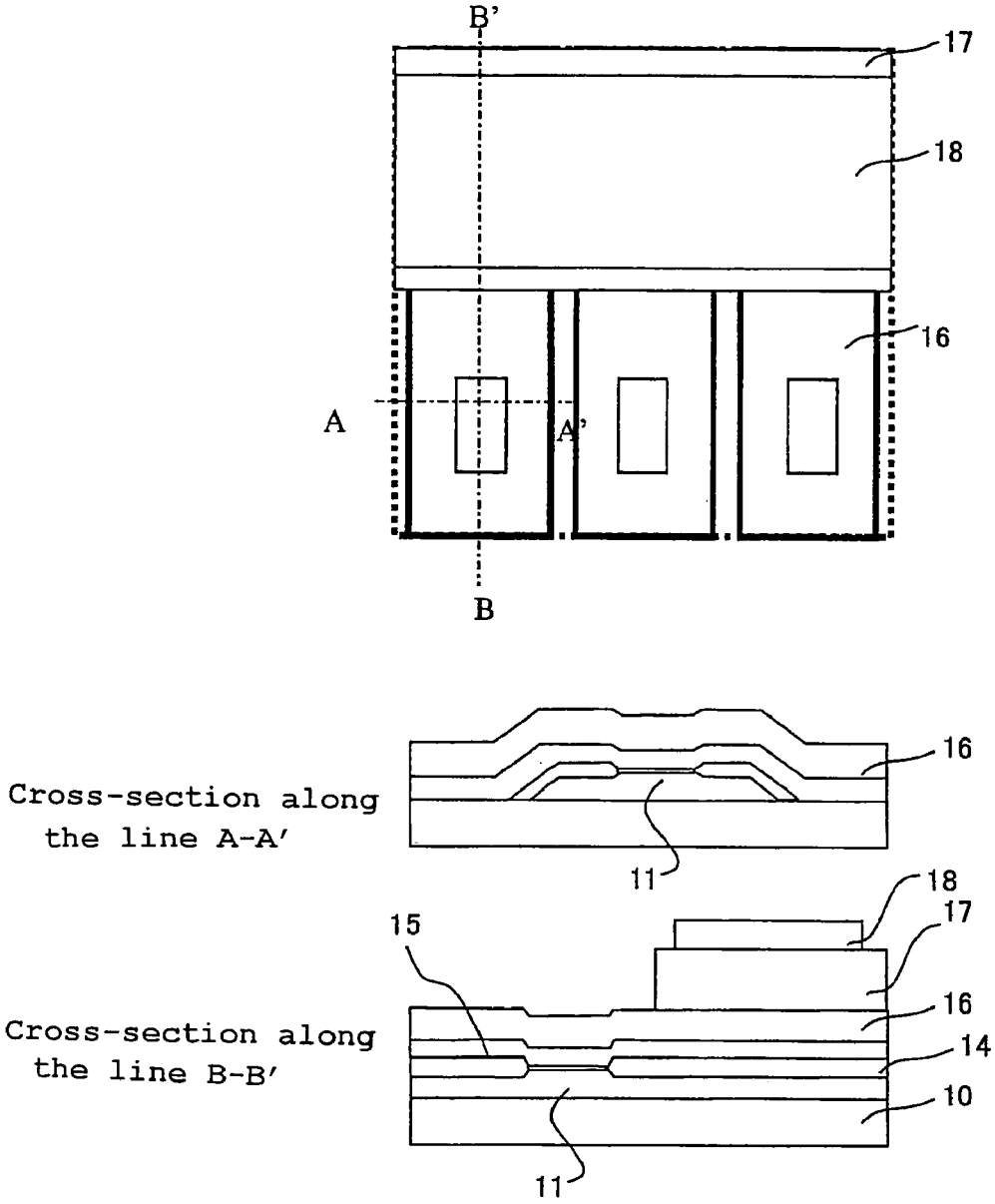
FIG. 8 represents drawings similar to those of FIG. 7, showing a method for manufacturing the thin-film type electron source of the present invention.

Then, the metal upper layer 18 is processed by patterning and etching processes to have a stripe-like form perpendicularly crossing the bottom electrode 11. For the etching, wet etching using aqueous solution of cerium diammonium nitrate is adopted (FIG. 8).

Figure 9:
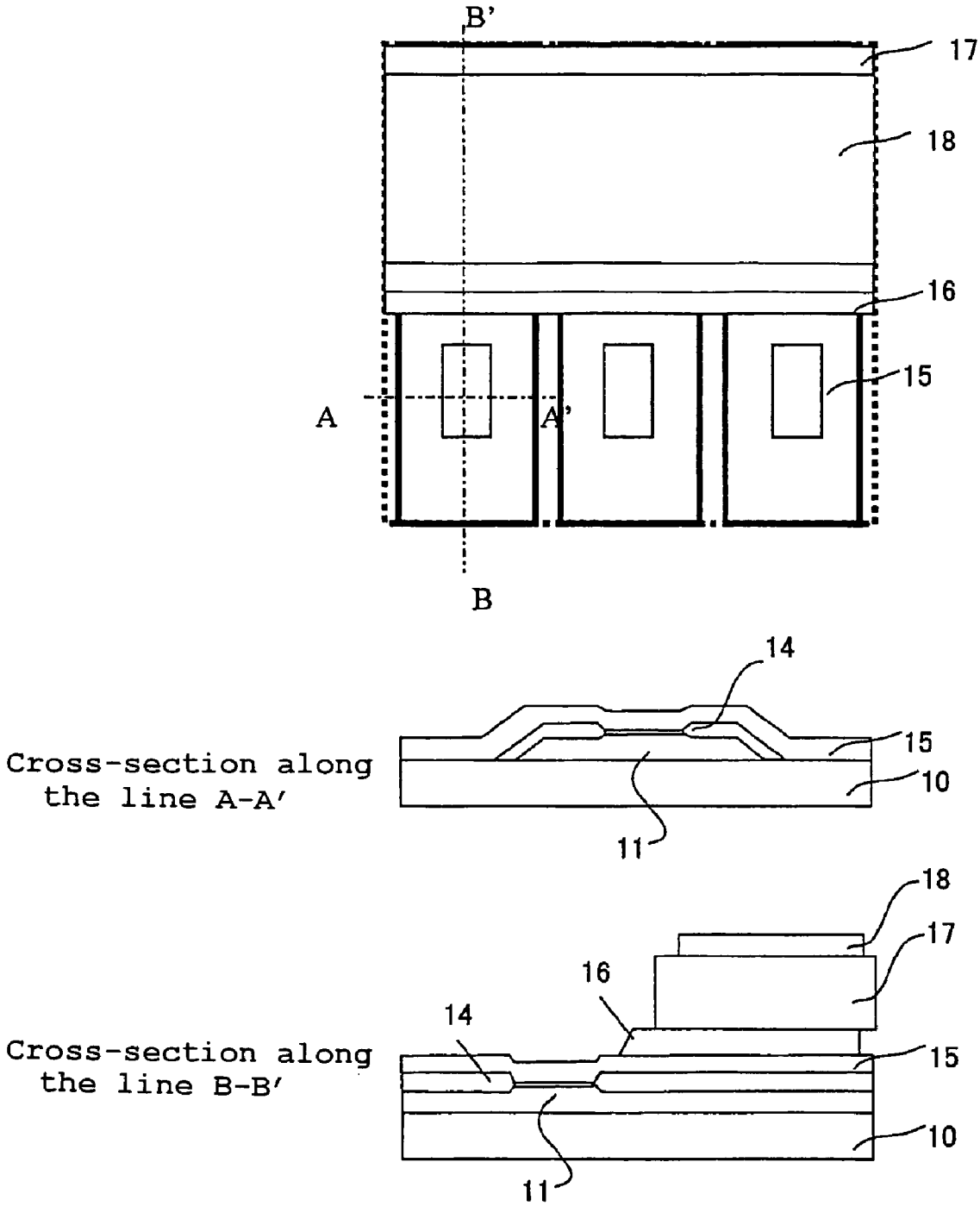
FIG. 9 represents drawings similar to those of FIG. 8, showing a method for manufacturing the thin-film type electron source of the present invention.

Next, as shown in FIG. 9, the metal lower layer 16 is processed by patterning and etching to have a stripe-like form perpendicularly crossing the bottom electrode 11. For the etching, wet etching is adopted using a mixed solution of phosphoric acid and acetic acid. In this case, one side (the side closer to the electron source; left side in the cross-sectional view along the line B-B' in FIG. 9) of the metal lower layer 16 is made protruded from the metal upper layer 18, and it is turned to a contact electrode to maintain connection with the top electrode 13. The other side of the metal lower layer 16 (the side opposite to electron source forming side; right side in the cross-sectional view along the line B-B' in FIG. 9), an undercut is formed by using the metal upper layer 17 as mask, and an eave is formed, which separates the top electrode 13 in subsequent process. As a result, the top electrode 13 can be separated self-coordinatedly, and the scan line bus to supply power can be provided.

Figure 10:
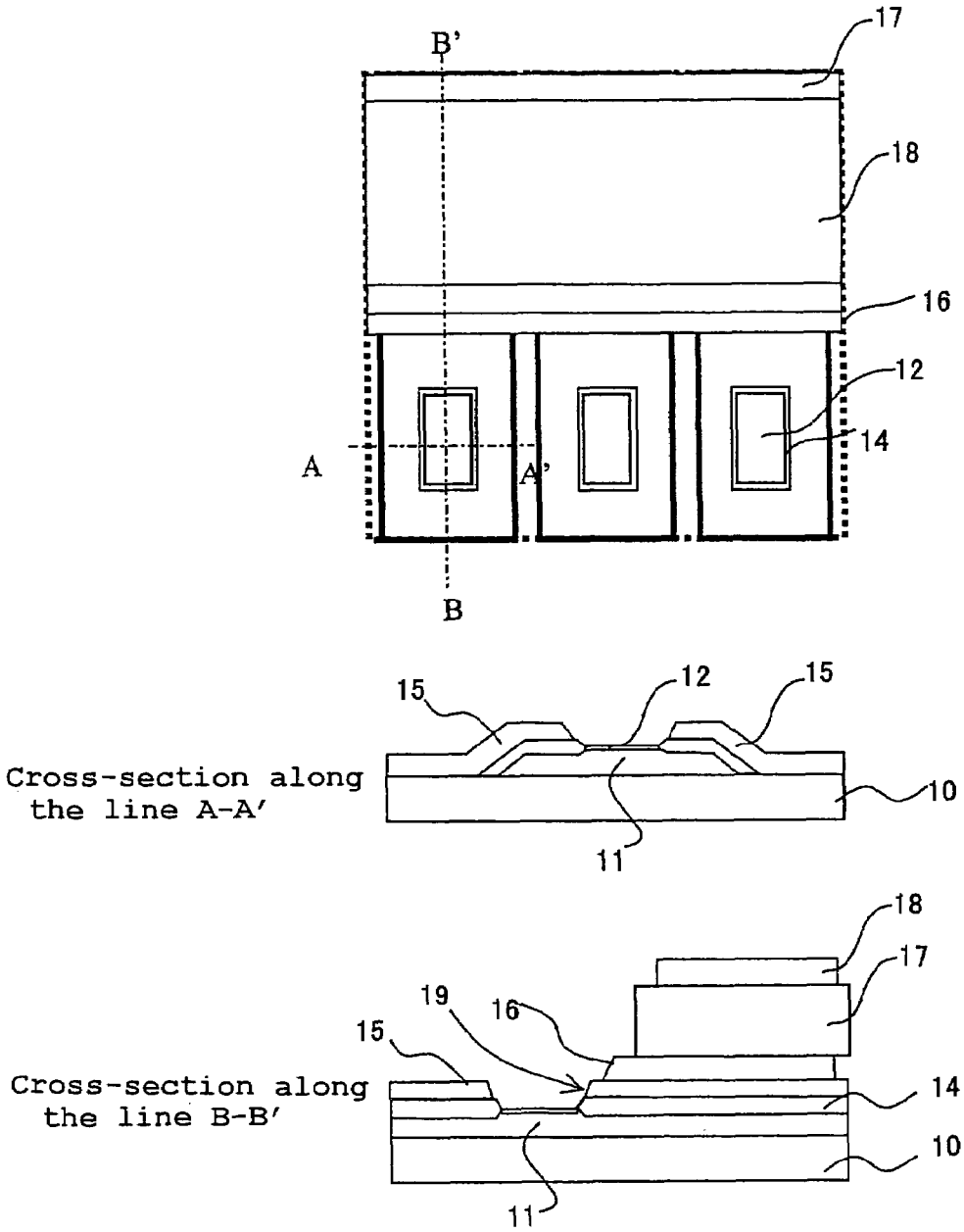
FIG. 10 represents drawings similar to those of FIG. 9, showing a method for manufacturing the thin-film type electron source of the present invention.

Then, the electron emission region is opened by processing of the interlayer insulator 15. The electron emission region is formed on a part of the intersection in a space interposed between one bottom electrode 11 within sub-pixel and the two upper bus electrodes perpendicularly crossing the bottom electrode 11. For the etching, dry etching using an etching agent with $CF_4$ or $SF_6$ as main component can be adopted (FIG. 10).

Figure 11:
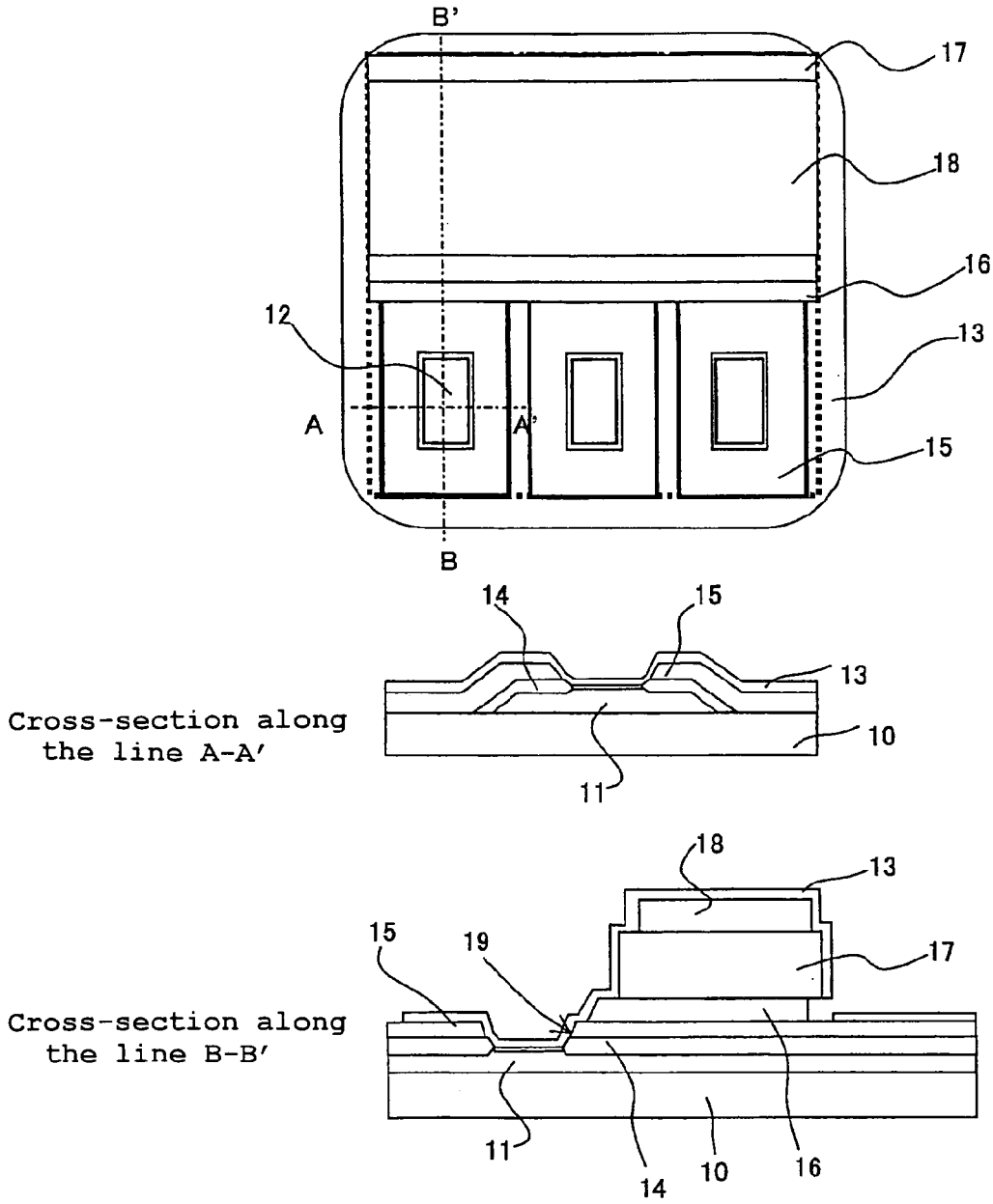
FIG. 11 represents drawings similar to those of FIG. 10 showing a method for manufacturing the thin-film type electron source of the present invention.

Finally, film deposition for the top electrode 13 is performed. For this film deposition, sputtering method is adopted. As the top electrode 13, a laminated film of Ir, Pt and Au is used, and film thickness is set to 6 nm, for instance. In this case, the top electrode 13 is cut off by an eave structure, which is formed by retraction of the metal lower layer 16 on one of the two scan line buss to sandwich the electron emission region (right side in the cross-sectional view along the line B-B' in FIG. 11). On the other hand, on the left side of FIG. 11, it is connected to contact portion of the metal lower layer 16 of the scan line bus (shown by the arrow 19) to ensure electric power supply (FIG. 11).

Figure 12:
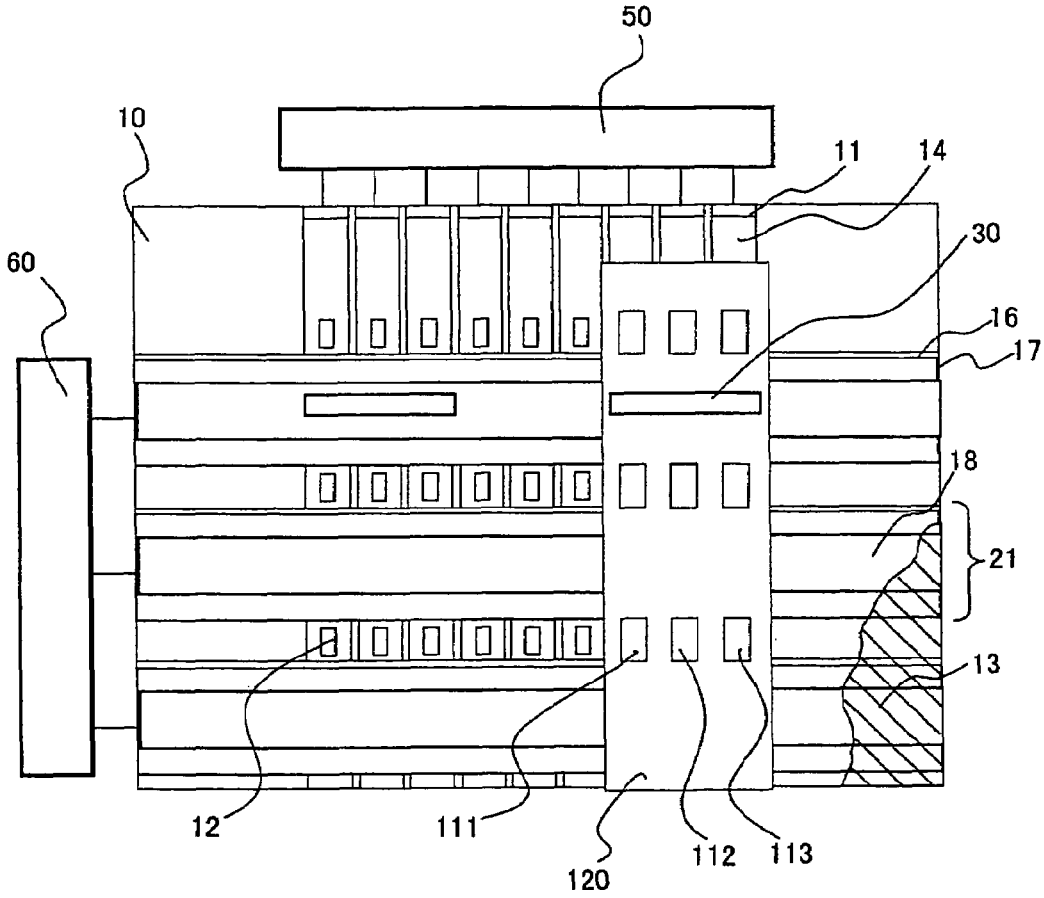
FIG. 12 is a drawing to explain an example of an overall arrangement of the image display device according to the present invention.

FIG. 12 is a drawing to explain an overall arrangement of the image display device of the present invention, and it is a schematical plan view to show an example of the image display device using MIM type thin-film electron source. FIG. 12 is a plan view of one side of the glass substrate (cathode substrate) 10 comprising electron source. For the other glass substrate with phosphor formed on it (phosphor substrate; color filter substrate), a black matrix 120 and phosphors 111, 112, and 113 are only partially shown, and the substrate itself is not shown in the figure.

On the cathode substrate 10, the following components are formed: the bottom electrode 11 comprising data line (signal electrode line) to connect to the data line driving circuit 50, the metal lower layer 16, the metal intermediate layer 17, and the metal upper layer 18 comprising data lines and scan lines (3-layer scan line bus) 21 to be connected to the scan line driving circuit 60, the field insulator 14 and other functional films (to be described later). The cathode (electron emission region, electron source) is connected to the top bus electrode, and it is formed on the top electrode (not shown) laminated on the bottom electrode 11 via the insulation layer. From the insulation layer (tunneling insulator 12) formed on thin layer of the insulation layer, electrons are emitted.

On the other hand, on inner surface of the display side substrate 10, there are provided a light shielding layer to promote contrast of the display image, a black matrix 120, a red phosphor 111, a green phosphor 112, and a blue phosphor 113. For example, $Y_2O_2S$:Eu can be used for the red phosphor (P22-R). ZnS:Cu, Al can be used for the green phosphor (P22-G), and ZnS:Ag, Cl can be used for the blue phosphor (P22-B). The cathode substrate 10 and the phosphor substrate are maintained at a predetermined spacing with a spacer 30 made of glass plate or ceramic plate interposed between them. A frame glass (sealing frame; not shown) is provided on outer periphery of the display region, and inner portion is sealed under vacuum condition.

The spacer 30 is placed above the scan line 21 of the cathode substrate 10, and it is arranged so that it is hidden under the black matrix of the phosphor substrate. The bottom electrode 11 is connected to the data line driving circuit 50, and the scan electrode 21 to make up the scan line bus is connected to the scan line driving circuit 60.

In this cathode structure, the wiring of aluminum or aluminum alloy of low resistance (e.g. Al—Nd) is sandwiched by chromium or chromium alloy having heat resistant property and anti-oxidation property to form scan line bus with laminated structure. As a result, the top electrode 13 can be processed self-coordinatedly in the display region. Also, it is possible to form the scan line bus, which is not deteriorated even through the sealing process. This makes it possible to suppress voltage drop by wiring resistance of the display device.

In the MIM electron source shown in FIG. 12, the bottom electrode 11 serving as data line on the cathode, the tunneling insulator 12, and the top electrode are laminated on the cathode substrate 10, and the electron emission region is formed. The portions other than the tunneling insulator 12 are electrically separated from the field insulator 14 and the interlayer insulator 15.

What is claimed is:

1. An image display device with a vacuum container, comprising thin-film type electron sources each placed at an intersection of a data line and a scan line crossing said data line via an insulation layer, a cathode substrate with said thin-film type electron sources arranged in form of matrix in a display region, a phosphor substrate having phosphor layers with a plurality of colors and an anode arranged to match each of the electron sources and a sealing frame to affix the two substrates together and interposed between said cathode substrate and said phosphor substrate around the display region, wherein:

a potential fixing electrode connected to an electrode with low impedance and a constant potential on the outermost side of at least a pair of sides adjacent to said display region.

2. An image display device according to claim 1, wherein said potential fixing electrode has the same wiring arrangement as said data line or said scan line, and an insulation layer is disposed at an intersection of said data line and said scan line.

3. An image display device according to claim 2, wherein said insulation layer positioned at the intersection of a pair of potential fixing electrodes having at least a pair of adjacent sides has the same arrangement as that of the insulation layer, which makes up said thin-film type electron source.

4. An image display device according to claim 2, wherein said data line is made of aluminum or aluminum alloy, and the insulation layer to make up said thin-film type electron source is an anodic oxidized film.

5. An image display device according to claim 3, wherein said data line is made of aluminum or aluminum alloy, and the insulation layer to make up said thin-film type electron source is an anodic oxidized film.

* * * * *